US006106088A

United States Patent [19]

Wafler

[11] Patent Number: 6,106,088

[45] Date of Patent: Aug. 22, 2000

[54] PRINTHEAD ASSEMBLY WITH INTEGRAL LIFETIME MONITORING SYSTEM

[75] Inventor: Walter F. Wafler, Pittsford, N.Y.

[73] Assignee: Xerox Corporation, Stamford, Conn.

[21] Appl. No.: 08/941,910

[22] Filed: Oct. 1, 1997

[51] Int. Cl.[7] ..... B41J 2/175

[52] U.S. Cl. ..... 347/7; 347/19; 399/27

[58] Field of Search ..... 347/7, 19; 399/27

[56] References Cited

U.S. PATENT DOCUMENTS

| | | | |
|---|---|---|---|
| Re. 32,572 | 1/1988 | Hawkins et al. | 216/27 |
| Re. 35,751 | 3/1998 | Midgley | 399/25 |
| 4,571,599 | 2/1986 | Rezanka . | |
| 4,771,295 | 9/1988 | Baker et al. | 347/87 |
| 4,947,192 | 8/1990 | Hawkins et al. | 347/59 |
| 4,961,088 | 10/1990 | Gilliland et al. | 399/25 |
| 5,010,355 | 4/1991 | Hawkins et al. | 347/64 |
| 5,021,828 | 6/1991 | Yamaguchi et al. | 399/24 |
| 5,121,343 | 6/1992 | Faris | 395/111 |
| 5,185,614 | 2/1993 | Courian et al. . | |
| 5,262,804 | 11/1993 | Petigrew et al. | 347/109 |
| 5,283,613 | 2/1994 | Midgley, Sr. | 399/9 |
| 5,365,312 | 11/1994 | Hillmann et al. | 399/12 |
| 5,486,855 | 1/1996 | Carlotta et al. | 347/87 |
| 5,534,902 | 7/1996 | Hoesly | 347/104 |
| 5,758,224 | 5/1998 | Binder et al. | 399/25 |

*Primary Examiner*—N. Le
*Assistant Examiner*—Craig A. Hallacher

[57] ABSTRACT

An ink jet printer of the type having a replaceable printhead assembly with a usage monitoring system detects and displays the remaining available use or lifetime for the printhead assembly installed in the printer. The droplet ejecting electrical pulses applied to selected heating elements of the printhead in the printhead assembly are counted and compared with the number of pulses assigned to a set of permanently inactivable or changeable cell sites integral with the printhead assembly. Each time the number of counted pulses are equal to the value assigned for a cell site, the cell site is addressed to change its state from active to inactive. The remaining active cell sites are representative of the percent of remaining available use for the installed printhead assembly, and this percentage is displayed for the convenience of the customer. Because the cell sites are permanently changed, the supplier can also determine the amount of use of the printhead assembly when warranty claims are submitted. In an alternate embodiment, the cell sites are the unused heating elements of spacing, inactivated nozzles which may be damaged or destroyed by lengthening the pulse duration of a pulse applied thereto when the assigned number of pulses per cell site have been reached.

7 Claims, 5 Drawing Sheets

PRINTHEAD ASSEMBLY WITH INTEGRAL LIFETIME MONITORING SYSTEM

BACKGROUND OF THE INVENTION

The invention relates to ink jet printing devices and more particularly to ink jet printers using a customer replaceable printhead assembly having an electronic monitoring system to record and display the amount of use or lifetime remaining for the installed printhead assembly.

For the convenience of the users or customers of ink jet printers, customer replaceable printheads are used which may be removed and replaced by the customer when the printhead's design lifetime has expired. The customer replaceable printheads also use customer replaceable ink supply tanks or cartridges, and each printhead may deplete the ink from many ink cartridges before reaching the end of its design lifetime. For existing multicolor ink jet printheads, it is not uncommon for the printhead to deplete the ink from as many as ten ink cartridges for each color, for example, yellow, magenta, cyan, and black, before reaching the end of the printhead lifetime. However, the customer tends to lose track of the remaining lifetime of the printhead when the replaceable cartridges are replaced a number of time and does not know when to replace the printhead. This can be a serious problem. Another problem occurs when the printhead is returned under a service warranty, because the manufacturer or supplier has no indication of the amount of use of the customer replaceable printhead, and it is difficult to determine what percentage of the printhead design lifetime has been consumed or if the design lifetime has been exceeded. The confusion over the amount of printhead lifetime consumed could provide a hardship on both the customer and the supplier, for it is difficult to determine if the customer deserves new printhead because the old one did not meet warranty or whether the printhead has been used up and the customer should purchase a new one.

U.S. Pat. No. 4,961,088 discloses a system for monitoring customer replaceable cartridges in printers or copiers. Each replaceable cartridge includes an electrically erasable programmable read only memory (EEPROM) which is programmed with a cartridge identification number that when matched a cartridge identification number in the printer or copier enables the printer or copier to operate, provides a cartridge replacement warning count, and provides a termination count at which the cartridge is disabled from further use. The EEPROM is programmed to store updated counts of the remaining number of images or prints available by the cartridge after each print or copy is made by the printer or copier.

U.S. Pat. No. 5,021,828 discloses a replaceable unit for use in a copier or printer in which initial use and near-end-of-life is recorded by electrical means, including a portion itself removable from the removable, comprising two fuses. A first fuse is blown when a few copies have been made with the replaceable unit, and the second fuse is used to prevent further use of the replaceable unit when a certain number of copies or prints have been made with the replaceable unit.

U.S. Pat. No. 5,283,613 discloses a monitoring system for replaceable cartridges in a printer or copier, including an electronic count memory and an electronic flag memory. The count memory maintains a one-by-one count of prints made with the cartridge. The flag memory includes a series of bits which are alterable from a first state to a second state but not alterable from the second state to the first state. The bits in the flag memory are altered at predetermined intervals as prints are made with the cartridge. The flag memory is used as a check to override unauthorized manipulation of the count memory.

U.S. Pat. No. 5,365,312 discloses replaceable ink reservoirs, ribbon cassettes, or toner cartridges having an electronic memory means in the form of a chip in which information is stored about the current fill status of the reservoir and other status data that are relevant for printer operation. The used status of the ink or other printing medium is acquired from the controller of the printing machine and is communicated to the chip. The chip on the reservoirs counts consumption until the supply is exhausted to such an extent the reservoir must be replaced. A reprogramming of the chip and refilling of the reservoir is not possible.

Because ink jet printers are typically designed for specifically formulated ink, it is important to know if the correct ink is used. It is damaging to the printheads to attempt to eject an ink droplet when the ink channels are empty, so it is also important to monitor the status of the amount of ink left in the cartridge prior to each attempt to print with it. Solutions to these problems have been sought, but precisely monitoring and feeding back information to the customer or supplier on the amount of the design life which has been consumed for a customer replaceable printhead remains to be solved, especially when many customer replaceable ink tanks have been installed, depleted of ink, and replaced.

SUMMARY OF THE INVENTION

It is an object of the present invention to electronically monitor the use of a customer replaceable printhead in an ink jet printer and to provide information to the customer and supplier on the amount of design life which has been consumed, so that a timely replacement printhead can be installed without inconveniencing the customer.

In one aspect of the invention, there is provided a method of recording the amount of use which has taken place for a given customer replaceable printhead for a printer in terms of portions of the printhead lifetime for feedback to either a customer or a supplier, comprising the steps of: establishing a printhead lifetime in terms of a total number of units of printing output achievable by said printhead; dividing the total number of printing output units into a plurality of groups of printing output units, each group of printing output units representing a portion of the printhead lifetime; storing the number of printing output units representing one of the groups of printing output units in a memory of the printer; providing a permanently switchable device on said printhead for each group of printing output units, the switchable devices being adapted to move from a conductive state to a permanently non-conductive state upon actuation thereof; counting the number of units of printing output accomplished by the printhead for each printing operation conducted by said printer; storing the number of counted units of printing output in the memory of the printer; comparing the number of counted units of printing output with the number of printing output units in said group stored in the printer memory; actuating one of the switchable devices each time the counted printing output units equal the number of printing output units in the one group thereof which is stored in the printer memory; and preventing further printing by the printer when all of the switchable devices on said printhead have been actuated, indicating that the printhead lifetime has expired, thereby requiring that the printhead be replaced.

In another aspect of the invention, there is provided an ink jet printer having a customer replaceable printhead adapted to record the amount of printing which has been accomplished by the printhead in terms of portions of printhead lifetime for feedback to either a customer or a supplier, comprising: a customer replaceable printhead having a plurality of nozzles with each nozzle having a heating element adjacent thereto, each heating element having a lifetime defined in terms of a total number N of energizations, each energization ejecting an ink droplet from the printhead; a printer controller having a memory for storing a designated number of heating element energizations which represent one portion of a group of equal portions of the printhead lifetime total number of energizations; means for counting and accumulatively storing the number of energizations of each of a selected group of heating elements in the printer memory; a plurality of permanently switchable devices, one switchable device for each portion of said group of equal portions of the printhead lifetime total number of energizations, the switchable devices being changed from a conductive state to non-conductive state permanently upon the actuation thereof; means for actuating one of the switchable devices each time the counted and stored number of energizations is equal to or greater than the number of heating element energizations stored in the printer memory which represent one of the equal portions of the printhead lifetime; and means for terminating a printer operation with the existing printhead when all of the switchable devices thereon have been actuated to the non-conductive state, thereby requiring that the printhead be replaced because the printhead has reached the end of its lifetime.

BRIEF DESCRIPTION OF THE DRAWINGS

The present invention will now be described by way of example with reference to the accompanying drawings, wherein like reference numerals refer to like elements and in which.

DESCRIPTION OF THE PREFERRED EMBODIMENT

Figure 1:
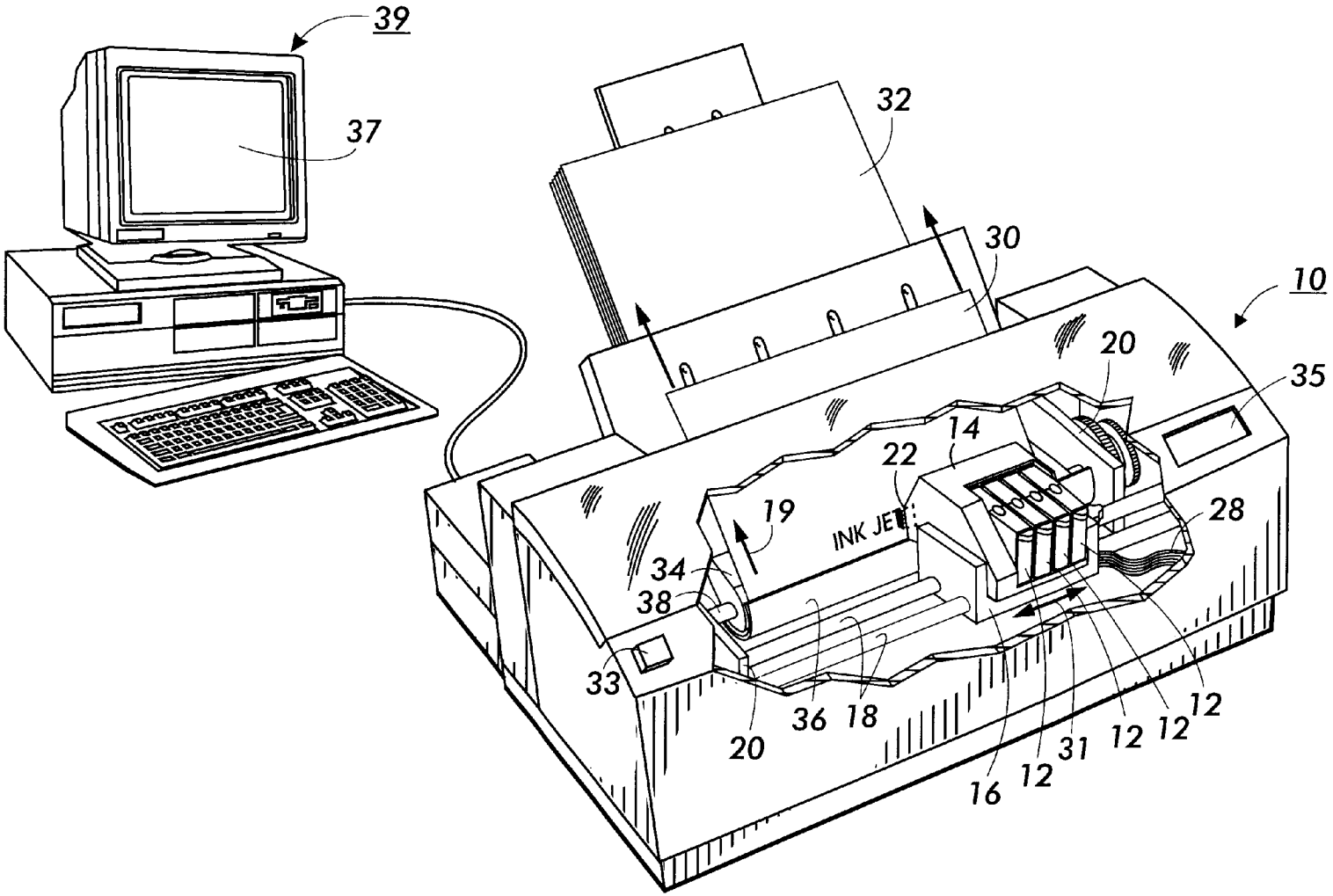
FIG. 1 is an isometric view of a carriage type multicolor ink jet printer having a customer replaceable printhead and separate customer replaceable ink supply tanks which incorporate the printhead use monitoring system of the present invention.

FIG. 1 illustrates an isometric view of a carriage type, multicolor thermal ink jet printer 10 having an electronic monitoring system for the customer replaceable printhead assembly 14, sometimes referred to as a Customer Replaceable Unit Monitoring System or CRUM system, described later. The printer is connected to personal computer 39 having a monitor 37 from which data is generated and directed to the printer for hard copies thereof. The printhead assembly includes four customer replaceable ink supply tanks 12 mounted therein. The ink supply tanks may each have a different color of ink, and in the preferred embodiment, the tanks have yellow, magenta, cyan, and black ink. The printhead assembly is installed on a translatable carriage 16 which is supported by carriage guide rails 18 fixedly mounted in frame 20 of the printer. The carriage is translated back and forth along the guide rails by any suitable means (not shown), such as, for example, a timing belt driven by an electrical motor, as is well known in the printer industry. The carriage is under the control of the printer controller 21, shown in FIG. 3. The printing operation by the printer may be initiated from the personal computer or the print start button 33 on the printer. Printer operational status and printing instructions may be obtained from the monitor 37 or the display panel 35 on the printer.

Figure 2:
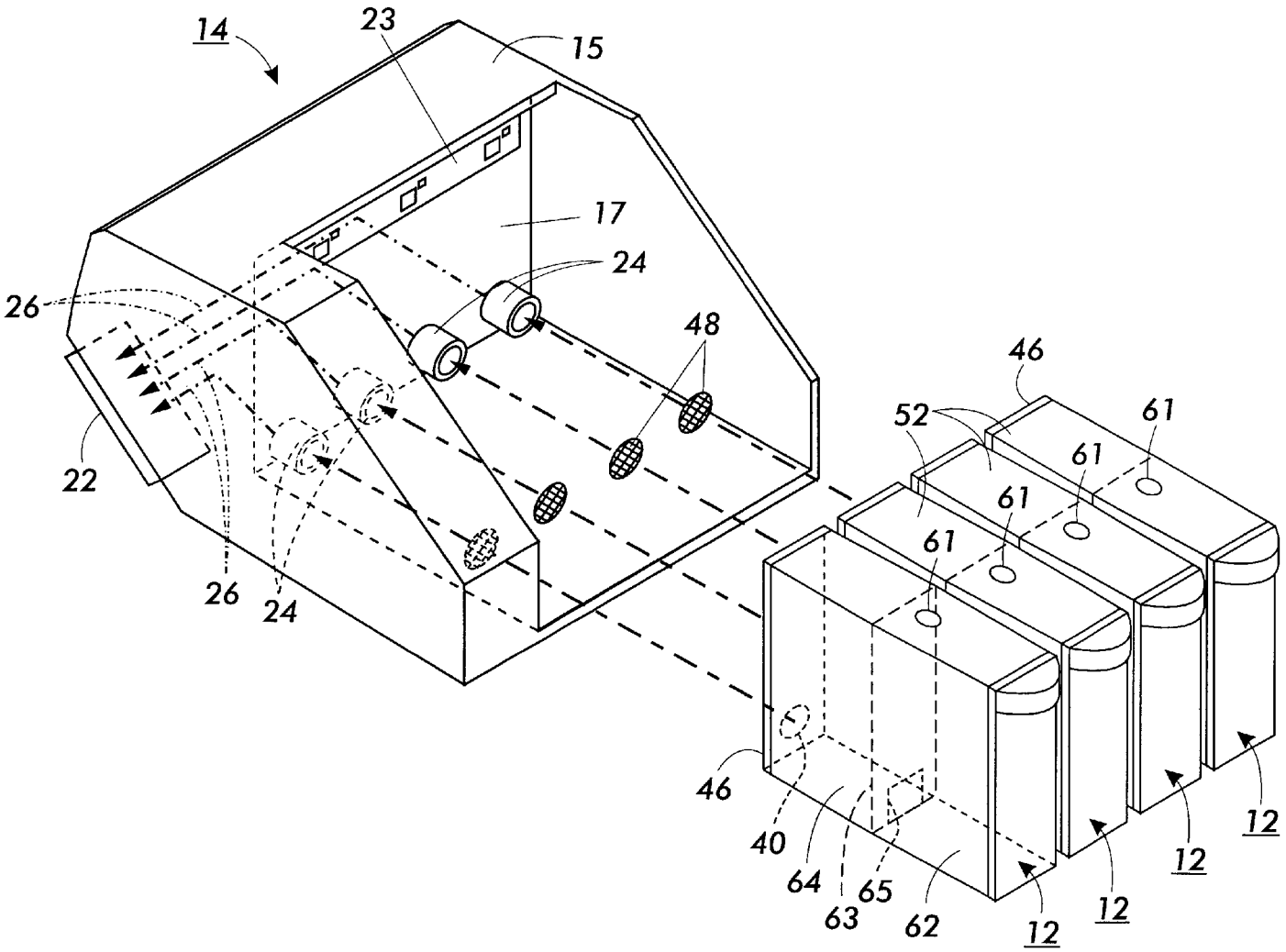
FIG. 2 is a partially exploded isometric view of the customer replaceable printhead and cartridges shown in FIG. 1.

Referring also to FIG. 2, the printhead assembly 14 comprises a housing 15 having an integral multicolor ink jet printhead 22 and ink pipe connectors 24 which protrude from a floor 17 of the printhead assembly for insertion into the outlet ports 40 of the ink supply tanks 12 when the ink supply tanks are installed in the printhead assembly housing. The protruding ink pipe connectors are usually covered by a wire mesh filter 48 to prevent particles or debris from the ink supply tanks from being carried by the ink into the printhead. Ink flow paths, represented by dashed lines 26, in the housing interconnects each of the ink pipe connectors with the separate inlets (not shown) of the printhead, one inlet for each color. The printhead assembly on which the replaceable ink supply tanks are mounted, includes an interfacing printed circuit board 23 that is connected to the printer controller 21 by ribbon cable 28 through which electric signals are selectively applied to the printhead to selectively eject ink droplets from the printhead nozzles 29. The multicolor printhead 22 contains a plurality of ink channels 27 with heating elements 44 (see FIG. 3) which carry ink from each of the ink supply tanks to respective groups of ink ejecting nozzles of the printhead.

When printing, the carriage 16 reciprocates back and forth along the guide rails 18 in the direction of arrow 31. As the printhead 22 reciprocates back and forth across a recording medium 30, such as single cut sheets of paper fed from an input stack 32 of sheets, droplets of ink are expelled from selected ones of the printhead nozzles towards the recording medium 30. The nozzles are typically arranged in a linear array perpendicular to the reciprocating direction of arrow 31. During each pass of the carriage 16, the recording medium 30 is held in a stationary position. At the end of each pass, the recording medium is stepped in the direction of arrow 19 for a distance equal to the height of a printed swath. For a more detailed explanation of the printhead and the printing thereby, refer to U.S. Pat. No. 4,571,599 and U.S. Pat. No. Re 32,572, the relevant portions of which are incorporated herein by reference.

A single sheet of recording medium 30 is fed from the input stack 32 through the printer along a path defined by a curved platen 34 and a guide member 36. The sheet is driven along the path by a transport roller 38 as is understood by those skilled in the art or, for instance, as illustrated in U.S. Pat. No. 5,534,902, incorporated herein by reference. As the recording medium exits a slot between the platen 34 and guide member 36, the sheet 30 is caused to reverse bow such that the sheet is supported by the platen 34 at a flat portion thereof for printing by the printhead 22.

With continued reference to FIG. 2, ink from each of the ink supply tanks 12 is drawn by capillary action through the outlet port 40 in the ink supply tanks, the ink pipe connectors 24 which extend through the outlet port 40, and ink flow paths 26 in the printhead assembly housing to the printhead 22. The ink pipe connectors and the flow paths of the housing thus supply ink to the ink channels of the printhead, capillarily replenishing the ink after each ink droplet ejection from the nozzle associated with the printhead ink channel. It is important that the ink at the nozzles be maintained at a slightly negative pressure, so that the ink is prevented from dripping onto the recording medium 30, and ensuring that ink droplets are placed on the recording medium only when a droplet is ejected by an electrical signal applied to the heating element in the ink channel for the selected nozzle. A negative pressure also ensures that the size of the ink droplets ejected from the nozzles remain substantially constant as ink is depleted from the ink supply tanks. The negative pressure is usually in the range of −0.5 to −2.0 inches of water. One known method of supplying ink at a negative pressure is to place within the ink supply tanks an open cell foam or needled felt in which ink is absorbed and suspended by capillary action. Ink tanks which contain ink holding material are disclosed, for example, in U.S. Pat. No. 5,185,614; U.S. Pat. No. 4,771,295; and U.S. Pat. No. 5,486,855.

The ink supply tanks 12 for a carriage type ink jet printer 10 comprises a housing 52 of any suitable material, such as, for example, polypropylene, having first and second compartments 62,64 which are separated by a common wall 63. Ink is stored in the first compartment 62 after introduction therein through ink inlet 61 which is subsequently covered. The second compartment 64 has an open cell foam member (not shown) inserted therein. Ink from the first compartment moves through aperture 65 in the common wall 63 to saturate the foam member with ink. The foam member is inserted into the second compartment through the open bottom thereof, and then the open bottom is covered by a bottom wall 46 of the same material as the housing 52. The bottom wall 46 has the open outlet port 40 and is heat staked to weld it to the housing 52 after the foam member is inserted.

Figure 3:
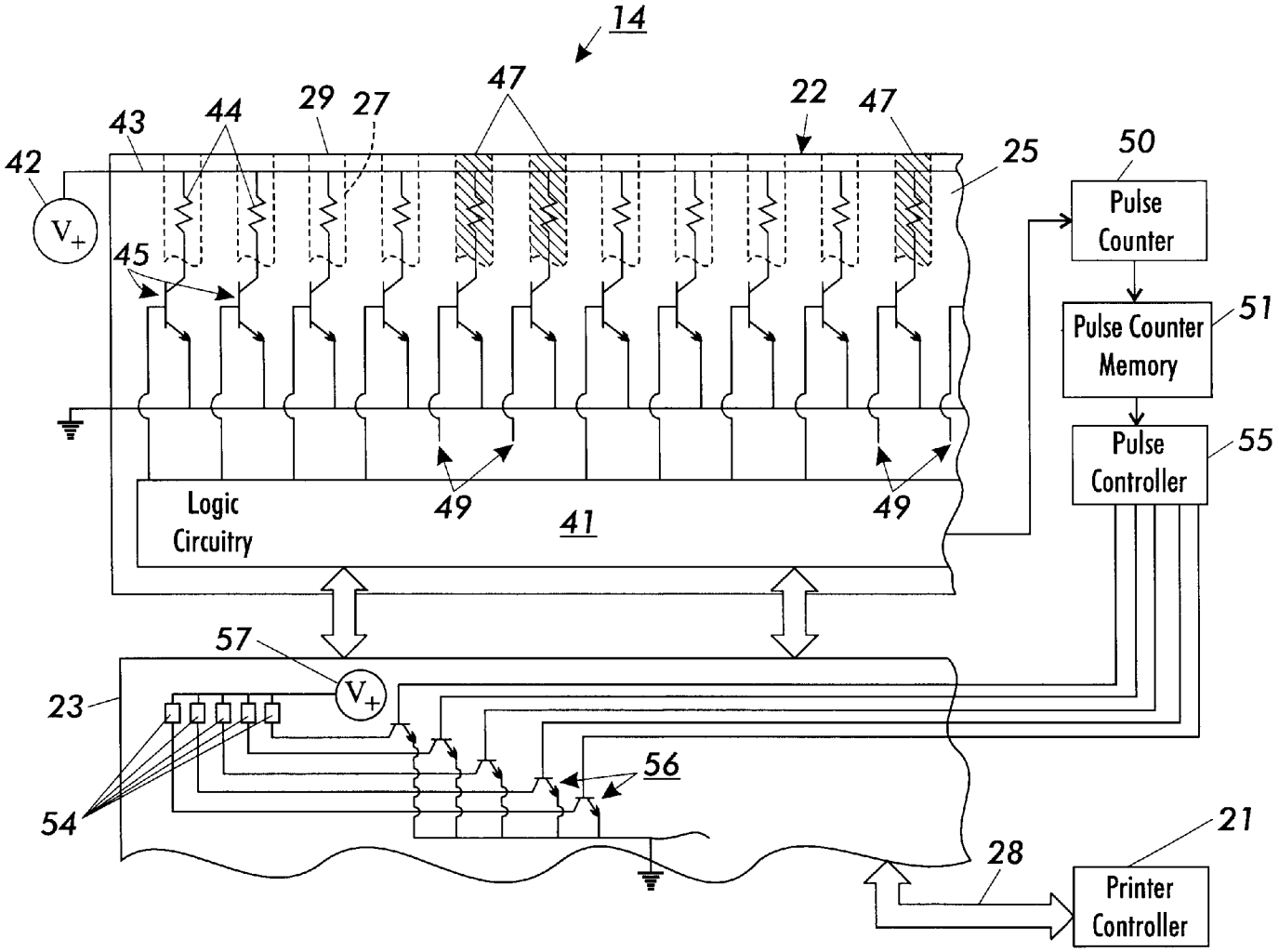
FIG. 3 is a partially shown plan view of an electrical diagram of an ink jet printer having the monitoring system of the present invention.

Referring to FIG. 3, a partially shown electrical diagram for the customer replaceable ink jet printhead assembly 14 of the printer in FIG. 1 is depicted. The printhead assembly includes printhead 22 which is similar to the printheads described in U.S. Pat. No. 4,947,192 and U.S. Pat. No. 5,010,355, both of which patents are incorporated herein by reference. The heating elements 44, such as described in these two incorporated patents, are located on a silicon substrate 25 of the printhead in capillarily filled ink channels 27 (partially shown in dashed line) a predetermined distance upstream from the channel open ends 29 which serve as the droplet ejecting nozzles. The predetermined distance is about 50 to 100 $\mu$m. The common return 43 is formed on the silicon substrate in the region between the nozzles and the heating elements. A voltage of 40 to 60 volts from voltage source 42 is applied to the common return. The heating elements 44 are connected to the common return and driver transistors 45. The heating elements are pulsed with this voltage on the common return through the driver transistors 45 which are in turn connected to the printhead logic circuitry 41. The transistor drains are connected to the heating elements, the transistor gates are connected to the logic circuitry, and the transistor sources are connected to ground.

Input data received by the printer controller or microprocessor 21 is processed thereby and, in response thereto, the heating elements are selectively pulsed to eject ink droplets by the driver transistors 45 via the printer controller 21, ribbon cable 28, circuit board 23, and logic circuitry 41 integrally formed on the printhead.

A typical multicolor printhead 22 for a carriage type printer 10 has a linear array of nozzles which are spaced from 300 to 600 per inch or more, In one embodiment, there are 128 nozzles which are grouped 48 for black ink and 24 each for yellow, magenta, and cyan. There are four inactive nozzles between the nozzles for black ink and the adjacent nozzles for the next color ink, and there are two inactive nozzles between each of the nozzles for non-black inks. In FIG. 3, only a few representative nozzles 29 of the 128 nozzles are shown, with the inactive nozzles 47 and associated channels 44 being shown as cross hatched and with their associated driver transistors having their gates not connected to the logic circuitry, as indicated at 49.

When the printhead is printing, a pulse counter 50 is counting the pulses applied to each of the heating elements or preferably to selected heating elements in each of the nozzle color groups. The number of pulse counts for each heating element is stored in the pulse count memory 51, which is typically a random access memory (RAM). The number of pulses (L) per heating element which has been determined to represent the lifetime thereof is typically about $1\times10^9$ pulses. This number of pulses L is divided by the number (F) of fusible cell sites or fuses 54 which will be used to permanently indicate the portion of heating element life which has been used or consumed by the printhead during the printing operations. The total number of cell sites would not be large. It has been determined that 8 to 24 cell sites should be sufficient, depending on the required precision of the electronic monitoring system and the expected life of the printhead.

In FIG. 3 only five cell sites are shown for ease of describing the invention. The lifetime number of pulses L divided by the number of cell sites F is the number N (L/F=N) and is also stored in the pulse count memory 51. During each printing operation, the number (P) of printing pulses applied to the selected heating elements is counted and stored in the pulse count memory. The stored pulse count P is continually compared to the number of pulses N by the pulse controller 55. If the printing pulses P is less than the number N, the printing pulses are retained in storage for continued accumulative summing with subsequent or continuing printing operations and continued or periodic comparing with the number N. When the printing pulses P are equal to N, the pulse controller enables transistor switch 56 and applies a voltage from the voltage source 57 to a one of the active cell sites. The voltage causes the cell site to be permanently changed to an inactive state, such as, for example, fused or melted. Concurrently the percentage of use which this quantity of pulses represents is subtracted from 100% and displayed on the printer display panel 35 or monitor 37 shown in FIG. 1, to inform the customer the status of the customer replaceable printhead assembly. In the example or embodiment shown in FIG. 3, F−1 is 5−1=4 and thus the remaining lifetime is 4/5 for 80%. Each time the counted pulses P equal the number N, another active cell site is permanently changed to the inactive state. When only one cell site is left the monitor 37 or printer display panel 35 displays "order new printhead assembly", and when the last cell site is inactivated, the printer is disabled until a new printhead assembly is installed.

Figure 5:
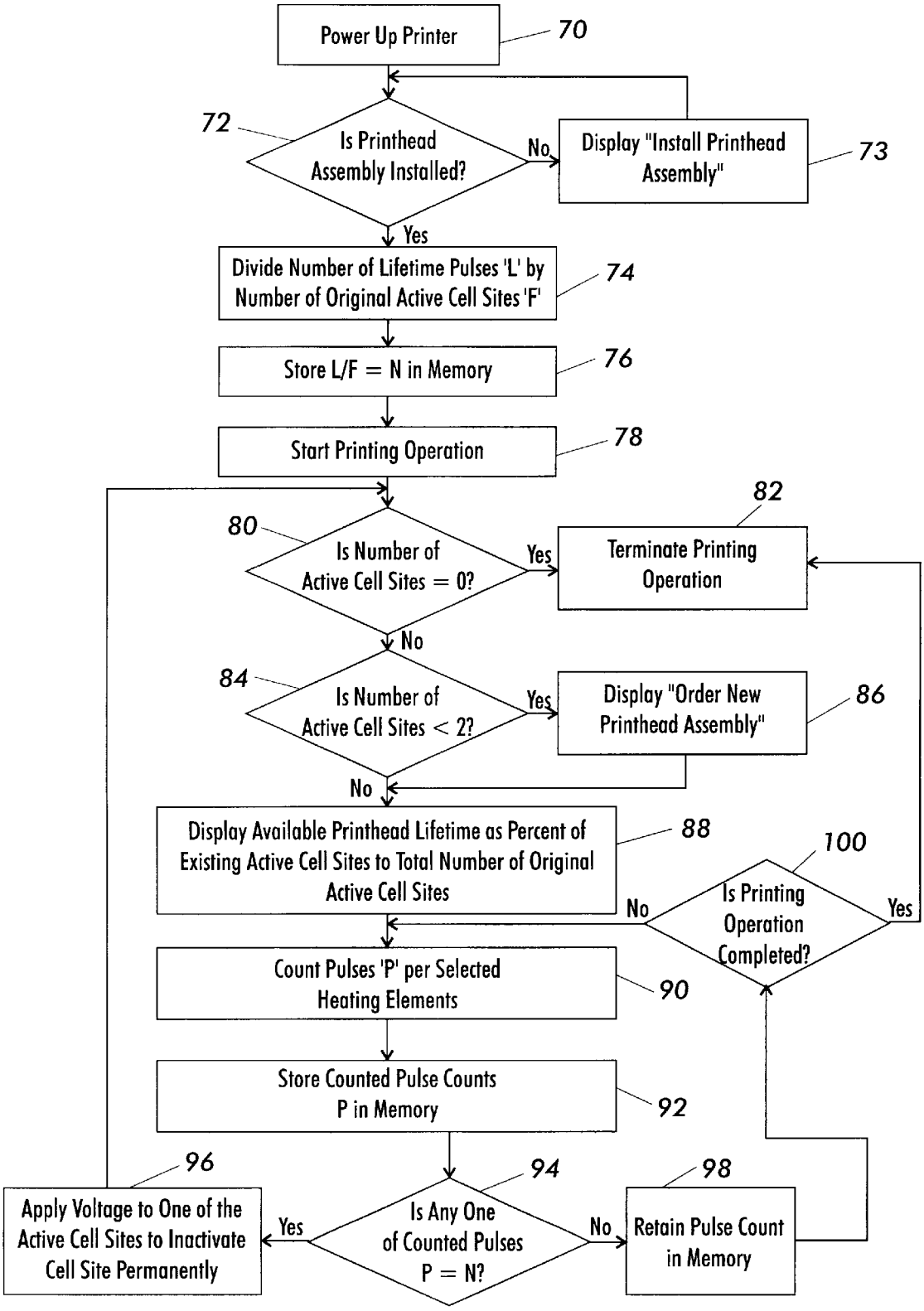
FIG. 5 is a flow chart depicting the monitoring system for recording and displaying the remaining lifetime of the customer replaceable printhead assembly in accordance with the present invention.

In FIG. 5, a flow chart depicts the monitoring system which records and displays the remaining lifetime of the installed printhead assembly. When the printer 10 is powered up at step 70, the printer controller checks at step 72 to see if a customer replaceable printhead assembly 14 is installed. If not, the printer panel 35 or the personal computer monitor 37 displays "install printhead assembly" at step 73 and prevents printing operation by the printer until a printhead assembly is installed. Once the printhead assembly is installed, the printer controller establishes the value N of each cell site by dividing the lifetime number of droplet ejecting pulses L a heating element can provide under manufacturer's warranty by the number F of cell sites provided by the customer replaceable printhead assembly. This is done at step 74 and may be optionally provided during the manufacture of the printhead assembly as a one time permanent entry. The value of L divided by F is N and this number is stored in the pulse count memory 51 at step 76. Again this step 76 could optionally be done at the factory prior to shipment of the printer. When the printing operation is started at step 78, the printer controller checks the number of active cell sites at step 80, where the printing operation is terminated at step 82 if there are no active cell sites left. At step 84, a check is made to determine if there is only one cell site left and, if so, it is time to obtain a new printhead. The printer display panel or monitor displays "order new printhead assembly" at step 86 to alert the customer that the end of life is near for the installed printhead assembly. The percent of remaining life of the printhead assembly is displayed at step 88 and the printing on the recording medium initiated. The pulse counter counts the electrical pulses P of each of the selected heating elements 44 at step 90 and stores the pulse count at periodic intervals in the pulse count memory 51 at step 92. The stored pulse count P is compared to the value of N at step 94 and, if it is equal to N, a voltage from voltage source 57 is applied to one of the active cell sites at step 96 by the transistor switch 56 that is turned on by the printer controller, so that the cell site is permanently changed to an inactive state. Each time a cell site is inactivated, steps 80, 84, and 88 are conducted. If the counted pulses are less than N, the pulse count is retained in memory 51 at step 98 for accumulative summing with subsequently counted pulses. After step 98, the completion of the printing operation is checked at step 100, and if not step 90 is conducted as the printing operation continues. If the printing operation is completed, then the printing operation is terminated at step 82.

Figure 4:
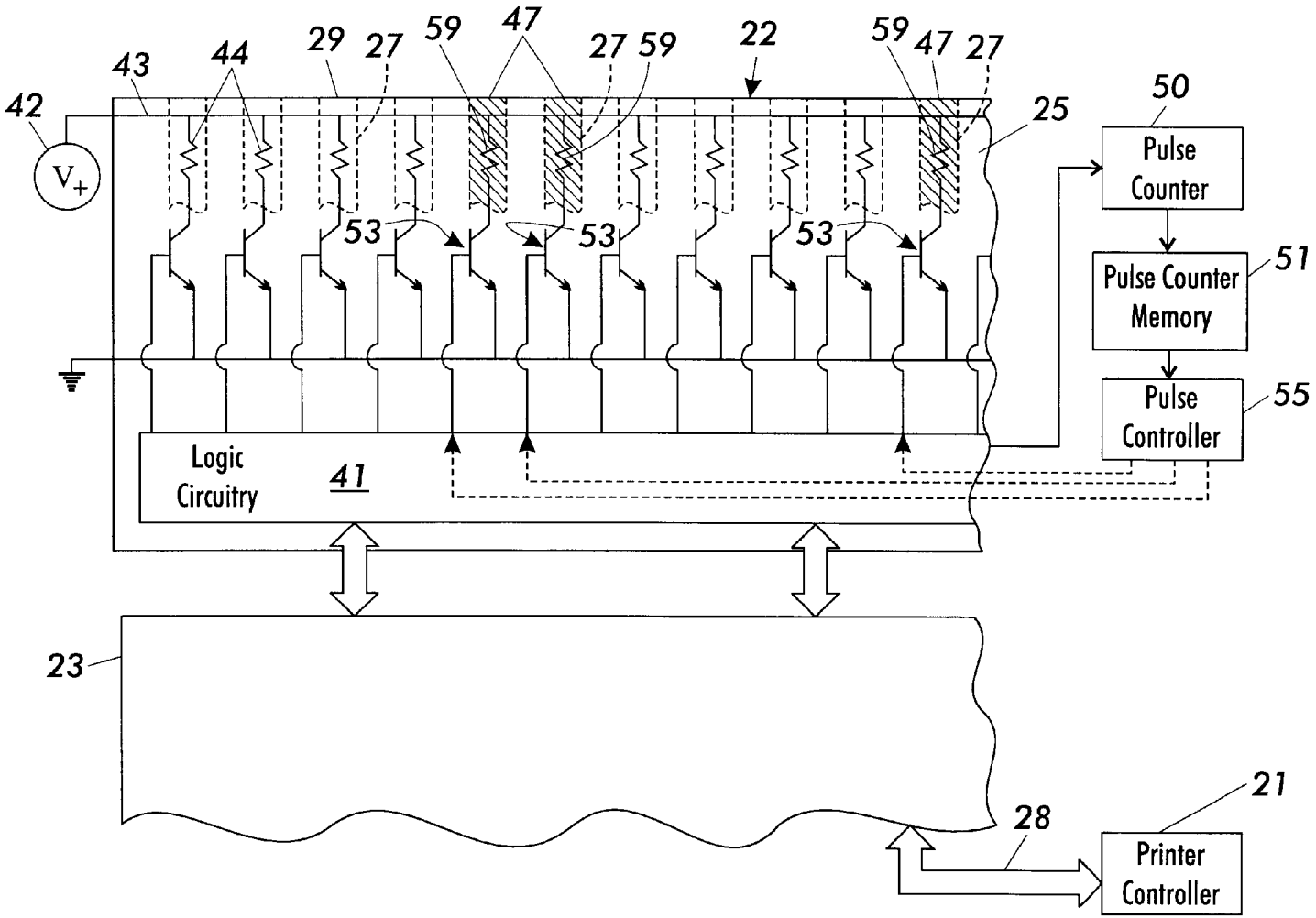
FIG. 4 is a partially shown plan view of an electrical diagram of an ink jet printer having an alternate embodiment of the monitoring system of the invention.

An alternate embodiment of the ink jet printer is shown in FIG. 4 in the form of a partially shown plan view of the electrical diagram, which is similar to that of FIG. 3. The differences are that the heating elements 59 of the inactivated nozzles 47 are used as the cell sites and the pulse controller 55 enables the driver transistors 53 for a pulse of longer duration than that normally used to expel an ink droplet, so that the heating element is permanently disabled or inactivated. The inactivation of a driver transistor is accomplished by about the same pulse amplitude as that used by normal driver transistors 44, but the pulse duration is about 6 to 8 $\mu$sec instead of the normal pulse duration of 3 $\mu$sec. Thus, in the embodiment described above with 128 nozzles grouped with 48 for black with four inactive nozzles between the nozzles designated for black and the next adjacent color and with two other sets of two inactive nozzles separating the other two colors, there are a total of eight 8 inactive nozzles which may be used as cell sites. The flow chart of FIG. 5 describes the monitoring system for the alternate embodiment, only there is no extra cell sites or extra switching transistors needed, for the unused heating elements serve as the cell sites.

Accordingly, the customer always knows how old the printhead assembly is and when the printhead assembly should be replaced. In addition, the supplier or manufacturer can readily determined the use of a printhead which fails the warranty period, so that a claim against a warranty can be confirmed or denied if the printhead assembly has been used up. Also, the printhead price can be readily prorated by the supplier because the amount of use can be quickly determined, if the printhead assembly fails to meet the performance guarantee.

Although the foregoing description illustrates the preferred embodiment, other variations are possible and all such variations as will be obvious to one skilled in the art are intended to be included within the scope of this invention as defined by the following claims.

What is claimed is:

1. A method of recording the amount of use which has taken place for a given replaceable printhead for a printer in terms of portions of the printhead lifetime for feedback to either a customer or a supplier, the replaceable printhead having a plurality of active nozzles and each active nozzle having a heating element, the heating elements of the active nozzles being selectively energizable by a printer controller to eject an ink droplet from the printhead nozzles, the method comprising the steps of:

(a) establishing a printhead lifetime in terms of a total number of units of printing output achievable by said printhead, each unit of printing output representing an energization of the heating elements of the active nozzles;

(b) dividing the total number of printing output units into a plurality of groups of printing output units, each group of printing output units representing a portion of the printhead lifetime;

(c) storing the number of printing output units representing one of the groups of printing output units in a memory of the printer;

(d) providing a plurality of non-droplet ejecting, inactive nozzles in said replaceable printhead, each inactive nozzle having a heating element associated therewith which functions as a permanently switchable device on said printhead for each group of printing output units, the heating elements of the inactive nozzles being adapted to move from a conductive state to a permanently non-conductive state when selectively energized by said printer controller;

(e) counting the number of units of printing output accomplished by the printhead for each printing operation conducted by said printer;

(f) storing the number of counted units of printing output in the memory of the printer;

(g) comparing the number of counted units of printing output with the number of printing output units in said group stored in the printer memory;

(h) selectively energizing one of the heating elements associated with an inactive nozzle each time the counted printing output units equal the number of printing output units in the one group thereof which is stored in the printer memory to cause the heating element associated with an inactive nozzle to move permanently from a conductive state to a non-conductive state; and (i) preventing further printing by the printer when all of the heating elements associated with the inactive nozzles on said printhead have been have been changed to the non-conductive state, indicating that the printhead lifetime has expired, thereby requiring that the printhead be replaced.

2. The recording method as claimed in claim 1, wherein the method further comprises the steps of:

(j) resetting the number of output units which has been counted and stored in the printer memory to zero each time a heating element associated with an inactive nozzle is caused to move to a non-conductive state; and (k) displaying the amount of heating elements associated with an inactive nozzle which are in the conductive state on a printer display panel for apprising a printer user of the status of the printhead lifetime.

3. The recording method as claimed in claim 2, wherein the display in step (k) is in percentage of remaining lifetime remaining as each heating element associated with an inactive nozzle which remains in the conductive state represents a portion of printhead lifetime.

4. The recording method as claimed in claim 1, wherein the number of units of printing output is the number of ink droplets ejected from selected nozzles; and wherein each group of printing output units has an equal number of said units therein.

5. An ink jet printer having a replaceable printhead adapted to record the amount of printing which has been accomplished by the printhead in terms of portions of printhead lifetime for feedback to either a customer or a supplier, comprising:

a replaceable printhead having a plurality of active and inactive nozzles with each active and inactive nozzle having a heating element adjacent thereto, each heating element of an active nozzle having a lifetime defined in terms of a total number N of energizations, each energization of a heating element of an active nozzle ejecting an ink droplet from the printhead;

a printer controller having a memory for storing a designated number of heating element energizations of the active nozzles which represent one portion of a group of equal portions of the N energizations representing the printhead lifetime;

means for counting and accumulatively storing the number of energizations of each of a selected group of heating elements in the printer memory;

the plurality of heating elements of the inactive nozzles functioning as permanently switchable devices, each heating element of the inactive nozzles representing one portion of said group of equal portions of the printhead lifetime total number of energizations of the heating elements of the active nozzles, the heating elements of the inactive nozzles being changed from a conductive state to non-conductive state permanently upon the energization thereof by said printer controller;

means for energizing one of the heating elements associated with an inactive nozzle by the printer controller each time the counted and stored number of energizations of said heating elements of the active nozzles is equal to or greater than the number of heating element energizations stored in the printer memory which represent one of the equal portions of the printhead lifetime; and means for terminating a printer operation with the existing printhead when all of the heating elements of the inactive nozzles have been energized to the non-conductive state, thereby requiring that the printhead be replaced because the printhead has reached the end of its lifetime.

6. The ink jet printer as claimed in claim 5, wherein the printer further comprises a display panel and means for displaying the number of heating elements of the inactive nozzles which are in the conductive state in terms of percentage of remaining printhead lifetime in order to apprise a user of the printer the status of the replaceable printhead.

7. The ink jet printer as claims in claim 5, wherein the inactive nozzles separate groups of active nozzles; and wherein each group of active nozzles eject ink droplets of different color.

* * * * *